US010819008B2

(12) United States Patent
Catchpole et al.

(10) Patent No.: US 10,819,008 B2
(45) Date of Patent: Oct. 27, 2020

(54) LIGHTING DEVICE, STREETLIGHTING DEVICE, TRAFFIC LIGHT, AND FABRICATION METHOD

(71) Applicants: Tyco Electronics UK Ltd., Swindon (GB); TE Connectivity Nederland BV, s'Hertogenbosch (NL); TE Connectivity Corporation, Berwyn, PA (US)

(72) Inventors: Jonathan Catchpole, West Hanney, PA (US); Wijnand Van Gils, Raamsdonksveer (NL); Leonard Henry Radzilowski, Palo Alto, CA (US); Yiliang Wu, San Ramon, CA (US); Luc Van Dommelen, Udenhout (NL)

(73) Assignees: Tyco Electronics UK Ltd., Swindon (GB); TE Connectivity Nederland BV, s'Hertogenbosch (NL); TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 16/421,814

(22) Filed: May 24, 2019

(65) Prior Publication Data

US 2019/0363424 A1 Nov. 28, 2019

(30) Foreign Application Priority Data

May 25, 2018 (EP) ..... 18174335

(51) Int. Cl.
*F21V 21/00* (2006.01)
*H01Q 1/24* (2006.01)
(Continued)

(52) U.S. Cl.
CPC ..... *H01Q 1/24* (2013.01); *F21S 8/085* (2013.01); *F21V 23/003* (2013.01); *H05B 47/19* (2020.01); *F21Y 2115/10* (2016.08)

(58) Field of Classification Search
CPC ..... H01Q 1/24; H05B 37/0272; F21S 8/085; F21Y 2115/10; F21V 23/003
(Continued)

(56) References Cited

U.S. PATENT DOCUMENTS

2010/0188301 A1 7/2010 Kishimoto et al.
2012/0274208 A1 11/2012 Chen et al.
(Continued)

FOREIGN PATENT DOCUMENTS

EP 1494312 A1 1/2005
WO 2017061869 A1 4/2017

OTHER PUBLICATIONS

European Patent Office European Search Report, Application No. 18174335.2, dated Oct. 22, 2018, 9 pages.

*Primary Examiner* — Laura K Tso
(74) *Attorney, Agent, or Firm* — Barley Snyder

(57) ABSTRACT

A lighting device includes a base, a transparent cover, an electronic circuit mounted to the base, and an antenna. The electronic circuit is connectable with a light emitting element adapted to emit a light through the transparent cover and/or a light receiving element adapted to receive a light through the transparent cover. The antenna has a radiating patch following a contour of an inner surface of the transparent cover and connected to the electronic circuit.

15 Claims, 3 Drawing Sheets

(51) Int. Cl.

| | |
|---|---|
| ***F21S 8/08*** | (2006.01) |
| ***F21V 23/00*** | (2015.01) |
| ***H05B 47/19*** | (2020.01) |
| *F21Y 115/10* | (2016.01) |

(58) Field of Classification Search
USPC ..... 362/249.02
See application file for complete search history.

(56) References Cited

U.S. PATENT DOCUMENTS

| | | | | |
|---|---|---|---|---|
| 2013/0234899 | A1* | 9/2013 | Pope | H01Q 1/243 343/702 |
| 2015/0002365 | A1 | 1/2015 | Mostoller et al. | |
| 2015/0195892 | A1* | 7/2015 | Park | F21V 3/04 362/311.01 |
| 2016/0036120 | A1 | 2/2016 | Sepanniitty et al. | |
| 2018/0054877 | A1 | 2/2018 | Creemers et al. | |
| 2019/0014650 | A1* | 1/2019 | Schroeder | H05B 47/19 |

* cited by examiner

LIGHTING DEVICE, STREETLIGHTING DEVICE, TRAFFIC LIGHT, AND FABRICATION METHOD

CROSS-REFERENCE TO RELATED APPLICATION

This application claims the benefit of the filing date under 35 U.S.C. § 119(a)-(d) of European Patent Application No. 18174335.2, filed on May 25, 2018.

FIELD OF THE INVENTION

The present invention relates to an antenna and, more particularly, to an antenna for streetlighting and traffic lights.

BACKGROUND

Streetlights can be operated and powered either as standalone devices which are powered for instance by photo cells, or may be controlled by a central management system. Moreover, photo detectors, also called light receivers, may be provided to detect sunset and sunrise and thus cause streetlighting to be automatically switched off and on accordingly. Light receivers may also be used in combination with a central management system as a control to check whether a command to switch on or off streetlighting given by the central management system is actually carried out.

There is a trend to increase energy savings by interconnecting such streetlights, which will be key components in smart city innovations. Wireless connections between streetlights representing nodes in a network require antennas to be mounted in close proximity to the streetlights. Providing suitable antennas is therefore an issue for the manufacturer of these streetlight nodes, mainly because of the restricted space. Moreover, the directional characteristics of the antenna need to be adapted to the particular requirements that result from the antennas' position at a streetlight.

SUMMARY

A lighting device includes a base, a transparent cover, an electronic circuit mounted to the base, and an antenna. The electronic circuit is connectable with a light emitting element adapted to emit a light through the transparent cover and/or a light receiving element adapted to receive a light through the transparent cover. The antenna has a radiating patch following a contour of an inner surface of the transparent cover and connected to the electronic circuit.

BRIEF DESCRIPTION OF THE DRAWINGS

The invention will now be described by way of example with reference to the accompanying Figures, of which.

DETAILED DESCRIPTION OF THE EMBODIMENT(S)

The accompanying drawings are incorporated into and form a part of the specification to illustrate several embodiments of the present invention. These drawings together with the description serve to explain the principles of the invention. The drawings are merely for the purpose of illustrating examples of how the invention can be made and used and are not to be construed as limiting the invention to only the illustrated and described embodiments. Furthermore, several aspects of the embodiments may form—individually or in different combinations—solutions according to the present invention. Further features and advantages will become apparent from the following more particular description of the various embodiments of the invention, as illustrated in the accompanying drawings, in which like references refer to like elements.

Figure 1B:
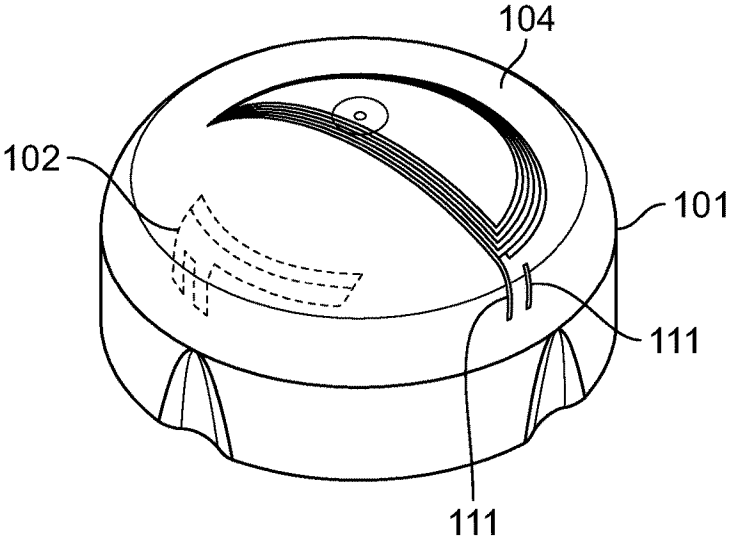
FIG. 1B is a perspective view of the lighting device of FIG. 1A.
Figure 1C:
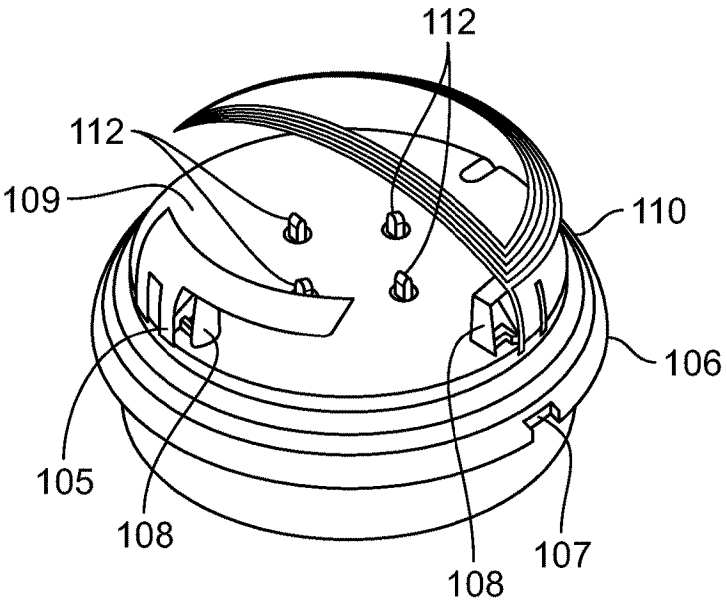
FIG. 1C is a perspective view of the lighting device of FIG. 1A without a cover of the lighting device.
Figure 1A:
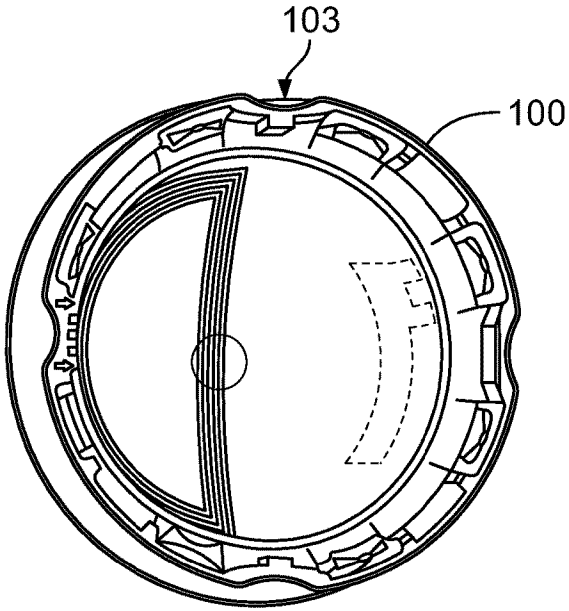
FIG. 1A is a top view of a lighting device according to an embodiment.

A lighting device 100 according to an embodiment is shown in FIGS. 1A-1C. The lighting device 100 comprises a radiating patch of a Bluetooth antenna 102 and an NFC antenna 104.

In an embodiment, the antennas 102, 104 are each a micro-strip patch antenna. A micro-strip or printed antenna 102, 104 is an antenna fabricated using micro-strip techniques on the dielectric substrate. The printed antennas 102, 104 are mostly used at microwave frequencies. An individual micro-strip antenna 102, 104 consists of a patch of metal foil of various shapes (a patch antenna) on the surface of the dielectric substrate, with a metal foil ground plane on the other side of the substrate. The antenna 102, 104 is usually connected to the transmitter or receiver through foil micro-strip transmission lines. The radio frequency current is applied (or in receiving antennas the received signal is produced) between the antenna 102, 104 and ground plane.

An active antenna is an antenna that contains active electronic components such as transistors, in contrast to most antennas which only consist of passive components such as metal rods, capacitors and inductors. Active antenna designs allow antennas of limited size to have a wider frequency range (bandwidth) than passive antennas, and are primarily used in situations where a larger passive antenna is either impractical (inside a portable radio) or impossible (suburban residential area that disallows use of large outdoor low-frequency antennas).

The most common type of micro-strip antenna is the patch antenna. Antennas using patches as constitutive elements in an array are also possible. A patch antenna is a narrowband, wide-beam antenna fabricated by etching the antenna element pattern in metal trace bonded to an insulating dielectric substrate, such as a printed circuit board, with a continuous metal layer bonded to the opposite side of the substrate which forms a ground plane. Common micro-strip antenna shapes are square, rectangular, circular and elliptical, but any continuous shape is possible. Some patch antennas do not use a dielectric substrate and instead are made of a metal patch mounted above a ground plane using dielectric spacers; the resulting structure is less rugged but has a wider bandwidth. Because such antennas have a very low profile, are mechanically rugged and can be shaped to conform to the curving skin of a vehicle, they are often incorporated into mobile radio communications devices.

Micro-strip antennas are relatively inexpensive to manufacture and design because of the simple two dimensional physical geometry. They are usually employed at ultrahigh frequencies and higher frequencies because the size of the antenna is directly tied to the wavelength at the resonant frequency. A single patch antenna provides a maximum directive gain of around 6-9 dB. Usually, an array of patches is printed on a single (large) substrate using lithographic techniques.

The most commonly employed micro-strip antenna is a rectangular patch. It is about one-half wavelength long. The resonant length of the antenna is slightly shorter because of the extended electric "fringing fields" which increase the electrical length of the antenna slightly. Another type of patch antenna is the planar inverted-F antenna (PIFA). A PIFA antenna has a monopole antenna running parallel to a ground plane and grounded at one end. The antenna is fed from an intermediate point a distance from the grounded end. The design has two advantages over a simple monopole: the antenna is shorter and more compact, and the impedance matching can be controlled by the designer without the need for extraneous matching components. The antenna is resonant at a quarter-wavelength and also typically has good SAR properties. SAR stands for specific absorption rate and is a measure of how transmitted RF energy is absorbed by human tissue. The PIFA has a low profile and an omnidirectional pattern.

NFC antennas obey a different principle. The operating frequency of NFC is around 13.56 MHz. The corresponding wavelength is 22 meters long. To get a half-wave dipole antenna (that radiates well) a device about 11 meters in length would be needed. Hence, NFC antennas are not really antennas but inductors (coils) which induce electrical current in a second inductor nearby, thus the range of an NFC antenna is very short, being limited to 10 cm.

Though micro-strip antennas typically have a narrow bandwidth, it is possible to design micro-strip antennas with a wide bandwidth coverage. Some patch shapes show larger bandwidths than others. Patch shapes associated with larger bandwidths include annular rings, rectangular or square rings, and quarter-wave (shorted) patches. The Thesis "A wideband planar inverted F antenna for wireless communication devices" by Abhishek Thakur, Thapar University, 2016, describes a PIFA with a wide bandwidth cover over multiple frequency bands such as GPS (1575 MHz), DCS (1800 MHz), PCS (1900 MHz), 3G (2100 MHz), 4G (2300 MHz), and WLAN/Bluetooth (2400-2800 MHz). This conventional antenna has a compact structure, with dimensions of 66.39 mm×40 mm×3.8 mm. In its design, two slots are etched on the ground plane and adjusting the position of the slots helped to get wideband coverage over several communication standards. The antenna was designed using the High Frequency Structure Simulator (HFSS) software.

Both antennas 102, 104 comprise thin films, which are deposited on the inner side of the transparent cover 101 and form various structures. The antennas 102, 104 printed at the inner side of the transparent cover 101 of a lighting device exhibit a greater sideways radiation pattern compared to PCB track antennas. Thus, their radiation characteristics are more uniform and their ability to communicate with other antennas is less sensitive to their orientation. In an embodiment, the Bluetooth antenna 102 is a PIFA type antenna and the NFC antenna 104 is a coil antenna. In an embodiment, the antennas 102, 104 are operable to transmit and/or receive different signals.

In an embodiment, the antennas 102, 104 may be printed at the inner side of the transparent cover 101 using a jetting process. Jetting is based on dispensing small drops of conductive materials, for example conductive inks to locations, that are to be metallized. This deposition technique is particularly advantageous for transparent covers 101 with strong curvature and/or small dimensions. Example of jetting technologies include dispense jet, aerosol jet, and the like. Exemplary conductive inks may include polymer thick film (PTF) inks, nanoparticle inks, or combination of them. The ink can be cured at low temperatures that have no negative impact on the transparent cover of the lighting device. For example, when polycarbonate is used as the transparent cover 101 of the lighting device 100, the curing temperature will be no more than 120 degree C., including no more than 100 degrees C.

In another embodiment, the printing can be performed via pad printing. Pad printing is a technique that using a rubber pad to carry ink and transfer onto the inner surface of the transparent cover 101. In another embodiment, the printing can also be performed via rotary screen printing. The latter is a printing technique whereby a mesh is used to transfer ink onto a substrate, except in areas made impermeable to the ink by a blocking stencil. A blade or squeegee is moved across the screen to fill the open mesh apertures with ink, and a reverse stroke then causes the screen to touch the substrate transiently along a line of contact. This causes the ink to wet the substrate and be pulled out of the mesh apertures as the screen springs back after the blade has passed.

The antennas 102, 104 may comprise, for example, copper, copper silver alloys, silver, silver palladium alloy, or palladium. Any other suitable electrically conductive material, in particular metal or metal alloy, may of course also be used according to the present invention.

As shown in FIG. 1C, the lighting device 100 has a base 106 forming a closed cylinder. In an embodiment, the closed cylinder of the base 106 has a diameter of about 40 mm. An inner surface of the base 106 has a PCB or electronic circuit 109 including ground planes for both antennas 102, 104. Four electrical contacts 112 for contacting an LED lighting element protrude from the electronic circuit 109. In an embodiment, at least one electronic component is arranged on a first surface of the electronic circuit 109 opposing the transparent cover 101 and/or at least one electronic component is arranged on a second surface of the electronic circuit 109 which is opposite to the first surface. This allows for a particularly space saving arrangement of all necessary electronic components.

A transparent cover 101, as shown in FIG. 1B, forms an open cylinder. In an embodiment, the open cylinder of the transparent cover 101 has a diameter of about 40 mm and a slightly vaulted top. An opening of the cover 101 points toward the base 106 when the cover 101 and the base 106 are fitted together, and thus an inner space is formed. The cover 101 and the base 106 each have a height of, in an embodiment, about 13 mm. A distance between the inner surface of the base 106 and the top of the transparent cover 101, the distance between the ground plane and the radiating patch of the antenna 102, is about 13 mm in an embodiment.

The base 106, as shown in FIGS. 1A and 1C, has a notch 107 in which a bulge 103 of the transparent cover 101 can fit when the cover 101 and the base 106 are fitted together in the right relative azimuthal orientation. A sealing ring 110 residing at the interface between the base 106 and the transparent cover 101 seals the inner space against rain. Any other suitable gasket may of course also be used in place of the sealing ring 110.

In an embodiment, the lighting device 100 further comprises a snap-fit and a spring-clip, with a snap-fit of the base 106 engaging with a spring-clip of the transparent cover 101 to form a closed space. This has the advantage that the circuit, the actual light source as for example an LED, and the antenna 102, 104 are protected from weather effects such as rain. However, it is clear for a person skilled in the art that also other means of fixing the cover 101 at the base 106, such as screwing or ultrasonic welding, can also be used according to the present invention.

In the embodiment shown in FIGS. 1A-1C, the radiating patch of the NFC antenna 104 comprises a spiral formed by a flat conductive wire with a width of about 0.5 mm. The wire forms three windings which form a "D" shape, as shown in FIGS. 1A-1C, and is mounted on the slightly vaulted top of the transparent cover 101. A straight side of the D-shape runs diametrically over the transparent cover 101 and a round side of the D-shape runs along a border between the slightly vaulted top and the side of the cover 101. The wires from two adjacent windings have a distance of 0.5 mm to each other. The turns are arranged such that the outer turn encloses half of the area of the slightly vaulted top of the cover 101. A pair of antenna terminals 111 of the NFC antenna 104 are parallel to each other and run down along the side wall of the cover 101 downward toward the base 106. One of the terminals 111 serves as a feed, the other as a ground, through their connection with the electronic circuit 109 as described in the following.

Each terminal 111 is close to a connector 108 on the base 106 and connected to the electronic circuit 109, as shown in FIG. 1C. In the shown embodiment, each connector 108 has a rectangular housing from which a spring pushes a metal wire toward the corresponding antenna terminal 111 to establish an electric contact between the antenna terminal 111 and the electronic circuit 109.

In the embodiment shown in FIGS. 1A-1C, the radiating patch of the Bluetooth antenna 102 is deposited on a second half of the area of the slightly vaulted top of the cover 101. The antenna 102 has a conductive stripe with a width of about 5 mm and forms an arc of a circle running along the rim of the top of the cover 101, the arc having an arc length of about 45 degrees. At a side of one of a pair of ends of the long broad stripe, two narrow stripes each with a width of about 3 mm, representing contact tabs 105, are deposited next to and parallel to each other as shown in FIG. 1C. The contact tabs 105 run vertically from the top of the transparent cover 101 along the rim of the cover 101 down to the base 106. One of the contact tabs 105 serves as a feed, the other as a ground, through their connection with the electronic circuit 109 as described in the following.

Each contact tab 105 is close to a connector 108 on the base 106 that is connected to the electronic circuit 109. Each connector 108 has a rectangular housing from which a spring pushes a metal wire toward the corresponding contact tab 105 to establish an electric contact between the contact tab 105 and the electronic circuit 109.

In order to save space, the radiating patch of the at least one antenna 102, 104 is arranged in a region where the light is emitted during operation of the lighting device 100. Although this may have the effect that the light emission is reduced when compared to a device without an antenna, the antenna 102, 104 can be arranged to only partially cover the transparent cover 101 such that still sufficient light is emitted by the lighting device 100.

Fitting the base 106 and the transparent cover 101 together in the right relative azimuthal orientation via matching the notch 107 of the base and the bulge 103 of the transparent cover automatically establishes the contact between the antenna terminals 111 of the NFC antenna 104 and the corresponding connectors 108 on the base 106, as well as the contact between the contact tabs 105 of the Bluetooth antenna 102 and the corresponding connectors 108 on the base 106, thus establishing electric contacts between each antenna 102, 104 and the electronic circuit 109.

The NFC antenna 104 may be used to program or reprogram the lighting device 100, whereas the Bluetooth antenna 102 may be employed for the communication between neighboring street lights featuring such Bluetooth antennas. Such integrated antennas 102, 104 takes up less space and, by providing an antenna structure distanced apart from an upper surface of the base 106, the antenna 102, 104 has an improved directional characteristic. In an embodiment, existing lighting module designs such as the commercial module LUMAWISE Endurance S may be equipped with at least one antenna 102, 104 by applying an antenna structure to the inner surface of the transparent cover 101, in order to enable connected streetlighting. The module LUMAWISE Endurance S is offered by TE Connectivity and may comply with standards such as National Electrical Manufacturers Association (NEMA), sensor ready (SR), or with any other required standard.

In an embodiment, the lighting device 100 may be disposed in a streetlighting unit or a traffic light system. The present invention therefore also relates to a street light comprising the lighting device 100. In a traffic light system, the traffic light of a first road and the traffic light of a second road crossing the first road may communicate with each other such that before the first traffic light switches to green, the second traffic light switches to red, and vice versa. Wireless communication could also be used to reprogram traffic lights via a reprogramming device with an NFC sender on a stick, the NFC sender being held close to the antenna of the traffic light comprising such a lighting device 100. Furthermore, wireless communication could be used for communication of the traffic lights with a central management system, in order to control traffic dynamically on a large scale depending on a global traffic situation. In an embodiment, a luminaire comprises the lighting device 100 and a light emitting element, such as a light emitting diode (LED).

Figure 2B:
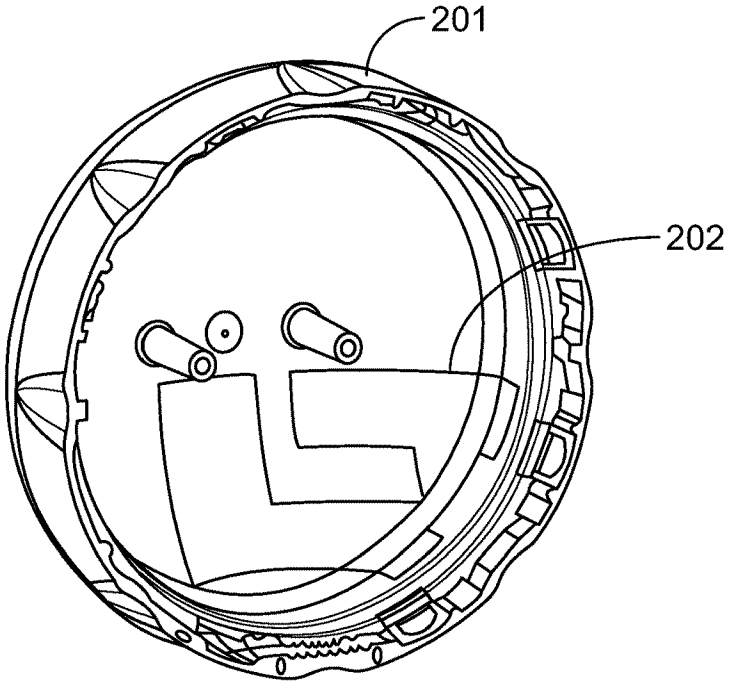
FIG. 2B is a bottom perspective view of the lighting device of FIG. 2A.
Figure 2A:
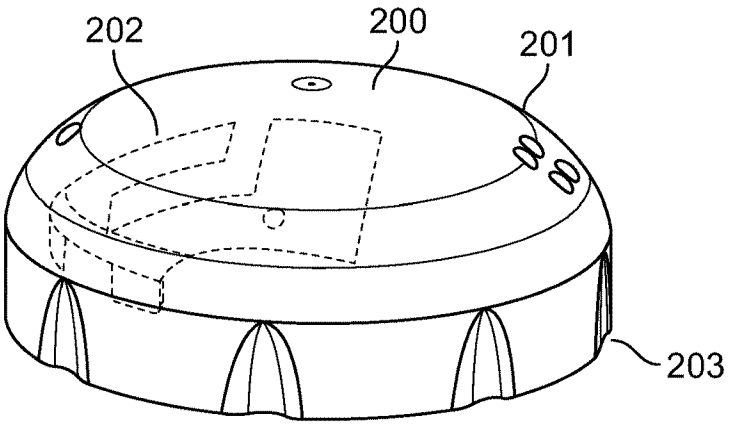
FIG. 2A is a top perspective view of a lighting device according to another embodiment.
Figure 2C:
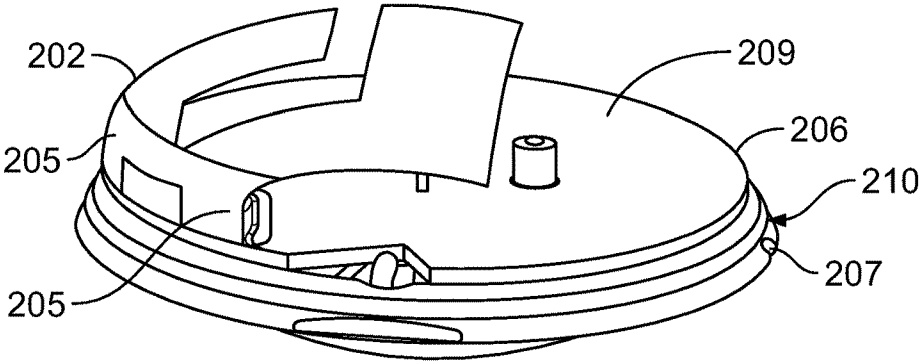
FIG. 2C is a top perspective view of the lighting device of FIG. 2A without a cover of the lighting device.

A lighting device 200 according to another embodiment is shown in FIGS. 2A-2C. The lighting device 200 comprises a radiating patch of a cellular antenna 202 forming a thin film with a structure. A base 206 forms a closed cylinder with a diameter of about 80 mm in an embodiment. An inner surface of the base 206 has a PCB or electronic circuit 209 which includes the ground plane. A transparent cover 201 forms an open cylinder with a height of about 20 mm, a diameter of 80 mm and a slightly vaulted top in an embodiment. An opening of the cover 201 cylinder points toward the base 206 when the cover 201 and the base 206 are fitted together, and thus an inner space is formed.

The base 206, as shown in FIG. 2C, comprises a notch 207 in which a bulge 203 of the transparent cover 201 can fit when the cover 201 and the base 206 are fitted together in the right relative azimuthal orientation. A sealing ring 210 disposed at the interface between the base 206 and the transparent cover 201 seals the inner space against rain.

The radiating patch of the cellular antenna 202 is deposited at an inner side of the top of the transparent cover 201, as shown in FIGS. 2A-2C. The radiating patch of the cellular antenna 202 has a shape of an arc of a circle, the arc having an arc length of about 90 degrees, and which has an L-shaped opening with an area of about a quarter of the area of the arc. In an embodiment, the width of the arc in radial direction is 13 mm. The radiating patch of the cellular antenna 202 is arranged such as to reside in one half of the top of the transparent cover 201. One side of the rectangle is kinked at the border between the top area and the side wall of the transparent cover 201. Two narrow stripes, each with a width of about 3 mm, representing contact tabs 205, are deposited next to and parallel to each other, as shown in FIG. 2C. The contact tabs 205 run vertically from the top of the transparent cover 201 along the side wall of the cover 201 down to the base 206. One of the contact tabs 205 serves as a feed, the other as a ground, through their connection with the electronic circuit 209 as described in the following. Each contact tab 205 is close to a connector 208 on the base 206 that is connected to the electronic circuit 209. Each connector 208 consists of a rectangular housing from which a spring pushes a metal wire toward the corresponding contact tab 205 to establish an electric contact between the contact tab 205 and the electronic circuit 209.

Fitting the base 206 and the transparent cover 201 together in the right relative azimuthal orientation via matching the notch 207 of the base and the bulge 203 of the transparent cover 201 automatically establishes contacts between the contact tabs 205 of the cellular antenna 202 and the corresponding connectors 208, thus establishing electrical contact between the antennas 202, 204 and the electronic circuit 209 on the base 206. In an embodiment, a distance between the inner surface of the base 206 and the top of the transparent cover 201, a distance between the ground plane and the radiating patch of the antenna 202, is about 20 mm.

The cellular antenna 202 shown in FIGS. 2A-2C may be employed for long range communication over distances of typically 10 km, which would be applicable, for example, for the communication of a street light with a central management system. In various embodiments, wireless communication between streetlights may implemented using various wireless communication standards, including cellular antennas (2G/&3G/4G) or Long Range Wide Area Network (LoRaWAN, "LoRa") with ranges of typically 10 km, as well as Bluetooth with ranges of typically 1-100 m and Near Field Communication (NFC) with a range of 10 cm. Cellular antennas and LoRa antennas may be employed for the communication between individual street lights and a Central Management center.

Figure 3B:
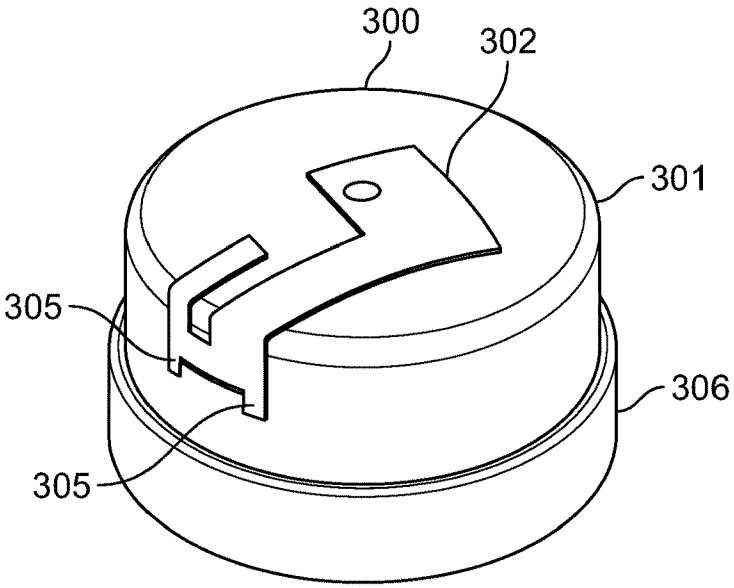
FIG. 3B is a top perspective view of the lighting device of FIG. 3A.
Figure 3C:
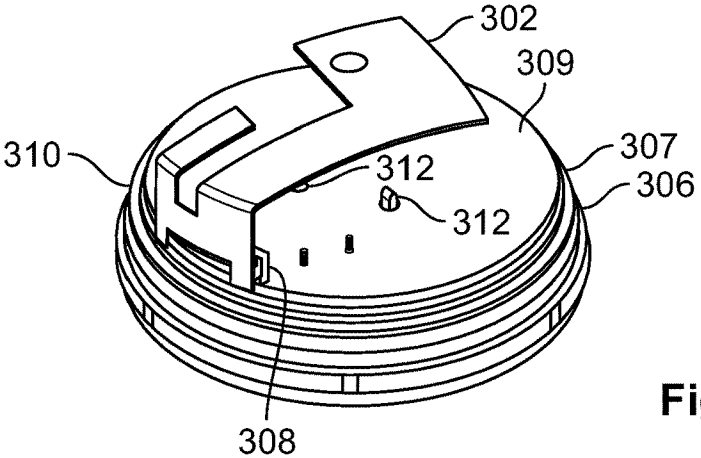
FIG. 3C is a top perspective view of the lighting device of FIG. 3A without the cover.
Figure 3A:
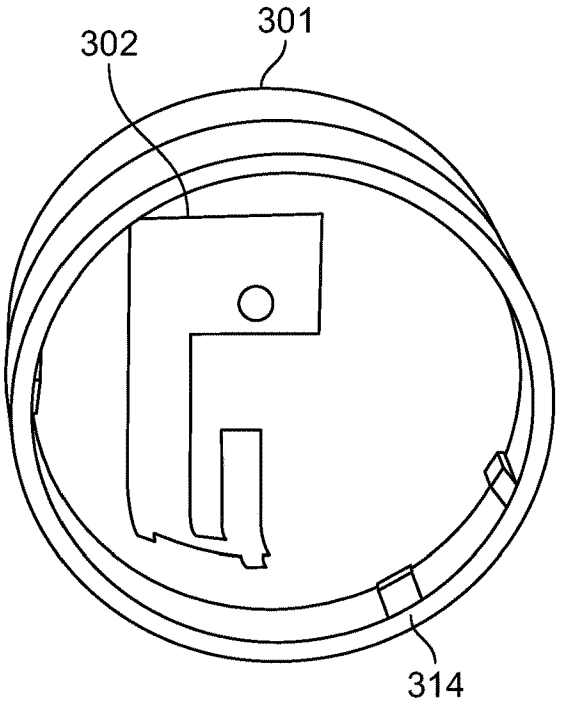
FIG. 3A is a bottom perspective view of a cover of a lighting device according to another embodiment.

A lighting device 300 according to another embodiment is shown in FIGS. 3A-3C. The lighting device 300 has a radiating patch of a second cellular antenna 302 forming a thin film with a structure.

As shown in FIGS. 3B and 3C, the base 306 forms a closed cylinder and, in an embodiment, has a diameter of about 80 mm. An inner surface of the base 306 has a PCB or electronic circuit 309 including the ground plane of the antenna 302. Two electrical contacts 312 for contacting an LED module and/or a light receiving element, for instance a photo diode, protrude from the electronic circuit 309.

The transparent cover 301 forms an open cylinder as shown in FIGS. 3A and 3B. The transparent cover 301, in an embodiment, has a height of about 30 mm, a diameter of 80 mm, and a flat top. An opening of the cover 301 cylinder points toward the base 306 when the cover 301 and the base 306 are fitted together, and thus an inner space is formed.

The radiating patch of the cellular antenna 302, shown in FIGS. 3A, 3B, and 3C, forms a rectangle, the greatest portion of which is deposited at the inner side of the top of the transparent cover 301. The cellular antenna 302 is arranged such that its long geometric axis runs along a diameter of the top of the transparent cover 301. In an embodiment of the cellular antenna 302, the length of the long axis of the rectangle is 37 mm and the width of the rectangle is 15 mm. The antenna 302 has an L-shaped opening with an area of about a quarter of the area of the rectangle. One side of the rectangle is kinked at the border between the top area and the side wall of the transparent cover 301. Two narrow stripes, each with a width of about 3 mm in an embodiment, representing contact tabs 305, are deposited next to and parallel to each other. The contact tabs 305 run vertically from the top of the transparent cover 301 along the side wall of the cover 301 down to the base 306. One of the contact tabs 305 serves as a feed, the other as a ground, through their connection with the electronic circuit 309 as described in the following. Each contact tab 305 is close to a connector 308 on the base 306 that is connected to the electronic circuit 309. Each connector 308 consists of a rectangular housing from which a spring pushes a metal wire toward the corresponding contact tab 305 to establish an electric contact between the contact tab 305 and the electronic circuit 309.

The base 306, as shown in FIGS. 3A and 3C, has a notch 307 in which a bulge 314 of the transparent cover 301 can fit when the cover 301 and the base 306 are fitted together in the right relative azimuthal orientation. A sealing ring 310 disposed at the interface between the base 306 and the transparent cover 301 seals the inner space against rain. Fitting the base 306 and the transparent cover 301 together in the right relative azimuthal orientation via matching the notch 307 of the base 306 and the bulge 314 of the transparent cover 301 automatically establishes contacts between the contact tabs 305 of the cellular antenna 302 and the corresponding connectors 308 on the base 306, thus establishing electrical contacts between the antenna 302 and the electronic circuit 309 on the base 306.

A distance between the inner surface of the base 306 and the top of the transparent cover 301, a distance between the ground plane and the radiating patch of the antenna 302, is about 30 mm in an embodiment and, hence, larger than the corresponding distance in the lighting device 200 shown in FIG. 2A-2C. Thus, the bandwidth of the lighting device 300 will be larger than the bandwidth of the lighting device 200.

According to the present invention, multiband antennas, i.e. antennas communicating via various standards, with frequencies in the sub-GHz regime, can be realized in a cost and space saving manner. Relevant communication standards can be 2G (General Packet Radio Service, GPRS), Enhanced Data Rates for GSM Evolution (EDGE), GMS, 3G (UTMS), and 4G (Long Term Evolution, including NarrowBand Internet of Things, NB-IoT). Such multiband antennas can be implemented with a suitable design of the antenna shape, and/or using active antennas which comprise active devices such as microwave integrated circuits to the antenna itself. Module manufacturers do not have to develop a separate design for luminaires that have RF communication capability.

The lighting device 100, 200, 300 according to the present invention may be mounted on a lamppost for streetlighting and may comprise one or more light emitting elements and/or one or more light receiving elements that activate the illumination automatically. In an embodiment, the electronic circuit 109, 209, 309 is connectable with the light emitting element adapted to emit a light through the transparent cover 101, 201, 301 and/or is connectable with the light receiving element adapted to receive a light through the transparent cover 101, 201, 301. The light emitting element may also be a separate part from the lighting device 100, 200, 300, in case that the lighting device 100, 200, 300 is only provided with one or more light sensitive elements connected to the electronic circuit 109, 209, 309.

What is claimed is:

1. A lighting device, comprising:

a base;

a transparent cover through which a light is emitted and/or received;

an electronic circuit mounted to the base;

a first antenna having a radiating patch following a contour of an inner surface of the transparent cover and connected to the electronic circuit; and a second antenna following the contour of the inner surface of the transparent cover and operable to transmit and/or receive different types of signals than the first antenna.

2. The lighting device of claim 1, wherein the radiating patch of the first antenna is arranged in a region where the light is emitted during operation of the lighting device.

3. The lighting device of claim 1, wherein a first electronic component is arranged on a first surface of the electronic circuit.

4. The lighting device of claim 1, further comprising a sealing ring arranged around an opening of the base and sealing a closed space between the base and the transparent cover.

5. The lighting device of claim 1, wherein the first antenna is a planar inverted-F antenna.

6. The lighting device of claim 1, wherein the first antenna is a coil.

7. The lighting device of claim 1, wherein the first antenna is a cellular antenna.

8. The lighting device of claim 1, wherein the first antenna is a long range antenna.

9. A luminaire, comprising:

a lighting device including a base, a transparent cover, an electronic circuit mounted to the base, a first antenna having a radiating patch following a contour of an inner surface of the transparent cover and connected to the electronic circuit, and a second antenna following the contour of the inner surface of the transparent cover and operable to transmit and/or receive different types of signals than the first antenna.

10. A streetlighting unit, comprising:

a lighting device including a base, a transparent cover, an electronic circuit mounted to the base, a first antenna having a radiating patch following a contour of an inner surface of the transparent cover and connected to the electronic circuit, and a second antenna following the contour of the inner surface of the transparent cover and operable to transmit and/or receive different types of signals than the first antenna.

11. A traffic light system, comprising:

a lighting device including a base, a transparent cover, an electronic circuit mounted to the base, a first antenna having a radiating patch following a contour of an inner surface of the transparent cover and connected to the electronic circuit, and a second antenna following the contour of the inner surface of the transparent cover and operable to transmit and/or receive different types of signals than the first antenna.

12. A method of fabricating a lighting device, comprising:

printing a radiating patch of each of a first antenna and a second antenna at an inner side of a transparent cover, the first antenna and the second antenna operable to transmit and/or receive different types of signals; and fitting the transparent cover on a base to form an enclosed space.

13. The method of claim 12, wherein the printing is performed by a jetting process.

14. The method of claim 13, further comprising mounting an electronic circuit to the base.

15. The method of claim 14, wherein the fitting of the transparent cover on the base forms a connection between the radiating patch of each of the first antenna and the second antenna and the electronic circuit.

* * * * *